United States Patent [19]

Gibson et al.

[11] 4,123,292

[45] Oct. 31, 1978

[54] METHOD OF TREATING STEEL STRIP AND SHEET SURFACES FOR METALLIC COATING

[75] Inventors: Alan F. Gibson, Middletown; Marvin B. Pierson, Franklin, both of Ohio

[73] Assignee: Armco Steel Corporation, Middletown, Ohio

[21] Appl. No.: 753,623

[22] Filed: Dec. 23, 1976

[51] Int. Cl.[2] ..... C23C 11/08

[52] U.S. Cl. ..... 148/6.35; 48/16; 427/248 E; 427/320; 427/321

[58] Field of Search ..... 427/319, 320, 321, 248 E, 427/55, 160; 148/6.35, 16

[56] References Cited

U.S. PATENT DOCUMENTS

| | | | |
|---|---|---|---|
| 2,197,622 | 4/1940 | Sendzimir | 427/251 |
| 2,562,770 | 7/1951 | Carter, Jr. | 427/160 X |
| 3,115,421 | 12/1963 | Seymour | 427/55 |
| 3,936,543 | 2/1976 | Byrd et al. | 427/320 |

*Primary Examiner*—Ronald H. Smith

*Assistant Examiner*—Evan K. Lawrence

*Attorney, Agent, or Firm*—Melville, Strasser, Foster & Hoffman

[57] ABSTRACT

A method of preparing the surfaces of steel strip and sheet stock for fluxless hot dip metallic coating, comprising the steps of passing the stock through a first heating section under conditions which form a visible iron oxide layer on the stock surfaces within the color range of dark straw through blue, continuing the heating of the stock in a second heating section isolated from the first heating section in an atmosphere containing less than 5% hydrogen by volume, thereby preserving the oxide layer, and cooling the stock approximately to the temperature of the molten coating metal in a cooling zone containing a reducing atmosphere comprising at least 10% hydrogen by volume, whereby to reduce the oxide layer completely to a metallic iron surface wettable by the coating metal. The radiant energy absorptivity of the steel stock is increased by the formation and preservation of the iron oxide layer in the first and second heating sections.

7 Claims, 2 Drawing Figures

METHOD OF TREATING STEEL STRIP AND SHEET SURFACES FOR METALLIC COATING

BACKGROUND OF THE INVENTION

1. Field of the Invention

This invention relates to the preparation of steel strip and sheet stock for hot dip coating with molten coating metal and more particularly to a method of preparation involving initial development of an oxide film on the stock surfaces, preservation of the oxide film during further heating, and reducing the oxide film while cooling the stock prior to immersion thereof in a molten coating metal bath. The invention has particular utility in the coating of carbon steels, low carbon rimmed and aluminum killed steels and low alloy steels, with aluminum, zinc, alloys of aluminum, alloys of zinc, and terne.

2. Description of the Prior Art

In the fluxless hot dip metallic coating of steel strip and sheet stock it is necessary to subject the surfaces to a preliminary treatment which provides a clean surface free of iron oxide scale and other surface contaminants, and which is readily wettable by the molten coating metal in order to obtain good adherence. Two types of in-line anneal preliminary treatments are in common use in this country, one being the so-called Sendzimir process or oxidation-reduction practice (disclosed in U.S. Pat. Nos. 2,110,893 and 2,197,622, to T. Sendzimir), and the other being the so-called Selas process or high intensity direct fired furnace line (disclosed in U.S. Pat. No. 3,320,085 to C. A. Turner, Jr.).

In the Sendzimir process steel strip or sheet stock is heated in an oxidizing furnace to a temperature of about 370°–485° C. without atmosphere control, withdrawn into air to form a controlled surface oxide layer varying in appearance from light yellow to purple or blue-grey, introduced into a reduction furnace containing a hydrogen and nitrogen atmosphere wherein the stock is heated to about 735°–925° C. and the controlled oxide layer is completely reduced. The stock is then passed into a cooling section containing a hydrogen and nitrogen atmosphere, brought approximately to the temperature of the molten coating metal bath, and then led beneath the bath surface while still surrounded by the protective atmosphere.

In the Selas process steel strip or sheet stock is passed through a direct fired preheat furnace section, heated to a temperature above 1315° C. by direct combustion of fuel and air therein to produce gaseous products of combustion containing at least about 3% combustibles in the form of carbon monoxide and hydrogen, the stock reaching a temperature of about 425°–705° C. while maintaining bright steel surfaces completely free from oxidation. The stock is then passed into a reducing section which is in sealed relation to the preheat section and which contains a hydrogen and nitrogen atmosphere, wherein it may be further heated by radiant tubes to about 425°–925° C. and/or cooled approximately to the molten coating metal bath temperature. The stock is then led beneath the bath surface while surrounded by the protective atmosphere.

British patent specification No. 1,170,057 published Nov. 12, 1969, discloses a method of preliminary treatment wherein steel strip or sheet is passed through a direct-fired first furnace in which the fuel-to-air ratio is controlled to provide an atmosphere which is slightly oxidizing to the steel, thereby producing an iron oxide layer of a thickness not greater than $10^{-5}$ inches, and is thereafter passed through a second furnace having an atmosphere which is mildly reducing, i.e., sufficient to reduce the iron oxide layer. In the first furnace the oxygen content is not more than $10^{-9}$ atmospheres oxygen pressure (about $10^{-7}$ percent). The atmosphere in the second furnace is maintained at not more than 15% hydrogen and balance inert gas. The first furnace is heated to a temperature of 1100° to 1500° C., and the temperature of the strip or sheet exiting therefrom is 400° to 950° C.

U.S. Pat. No. 3,936,543, issued Feb. 3, 1976, to F. Byrd et al., discloses an improvement in the Selas process, resulting in higher combustion efficiency and better production rates, wherein strip and sheet stock is heated to about 540° to 705° C. in a direct fired preheat furnace section heated to at least about 1205° C. and containing gaseous products of combustion ranging from about 3% by volume oxygen to about 2% by volume excess combustibles in the form of carbon monoxide and hydrogen, followed by heating in a reducing section containing at least about 5% hydrogen by volume (preferably at least 15%) to a temperature of at least about 675° C. Preferably the preheat furnace atmosphere contains 0% oxygen and 0% excess combustibles, i.e., perfect combustion. In this process the stock is heated above the critical strip temperature (i.e., that at which iron oxide is formed), and an iron oxide layer is formed having a thickness of the same order of magnitude ($10^{-5}$ inches) as in the above mentioned British patent.

SUMMARY OF THE INVENTION

The present invention constitutes a discovery that still greater increases in energy efficiency and/or production rates can be achieved in both the Sendzimir and Selas processes (as modified by Byrd et al.) by increasing the radiant energy absorptivity of the steel stock.

According to the invention there is provided a method of preparing the surfaces of steel strip and sheet stock for fluxless hot dip coating with molten metal, comprising the steps of passing the stock through a first heating section under conditions which form a visible iron oxide layer on the stock surfaces within the color range of dark straw through blue, continuing the heating of the stock in a second heating section isolated from the first heating zone in an atmosphere containing less than 5% hydrogen by volume, thereby preserving the oxide layer, and cooling the stock approximately to the temperature of the molten coating metal in a cooling zone isolated from the preceding heating zones, the cooling zone containing a reducing atmosphere comprising at least 10% hydrogen by volume, whereby to reduce the oxide layer completely to a metallic iron surface wettable by the coating metal.

The temperature to which the stock is heated in the successive heating sections is not critical as long as the formation of a thick oxide layer is avoided. In general the temperatures may be the same as those described above for conventional practice, i.e., for the Sendzimir process a range of about 370°–485° C. in the oxidizing furnace and about 735°–925° C. in the further heating zone; and for the process of the Byrd et al patent a range of about 540°–705° C. in the direct fired preheat section and at least about 675° C. (and up to about 925° C.) in the radiant tube heating section.

It is essential that the atmosphere in the first heating section be oxidizing to iron at least upon exit from this section. In the Sendzimir process this ordinarily occurs under conventional practice. However, in the Selas process, and the Byrd et al modification thereof, it is necessary to insure that substantially no excess combustibles be present in the atmosphere at least in the final portion of the preheat (first heating) section prior to strip exit, and the oxygen content preferably should range from about 0% to 2% by volume. Under these conditions an iron oxide layer of about $10^{-5}$ inches thickness is formed.

It is also an essential feature that the second heating section have an atmosphere containing less than 5% hydrogen by volume and substantially isolated from the atmosphere of the first heating section. A gas inert to the oxide layer, preferably nitrogen, is used.

It will be recognized that the higher absorptivity of the oxide layer decreases the residence time in the heating sections if the furnace temperatures are maintained at the conventional levels, thus increasing production rate. Alternatively, furnace temperatures could be reduced somewhat, thereby maintaining the same production rate at lower fuel (energy) requirements. Of course, a balance between increased production rate and lower fuel requirements could be effected.

BRIEF DESCRIPTION OF THE DRAWING

Reference is made to the accompanying drawing wherein.

DESCRIPTION OF THE PREFERRED EMBODIMENTS

Figure 1:
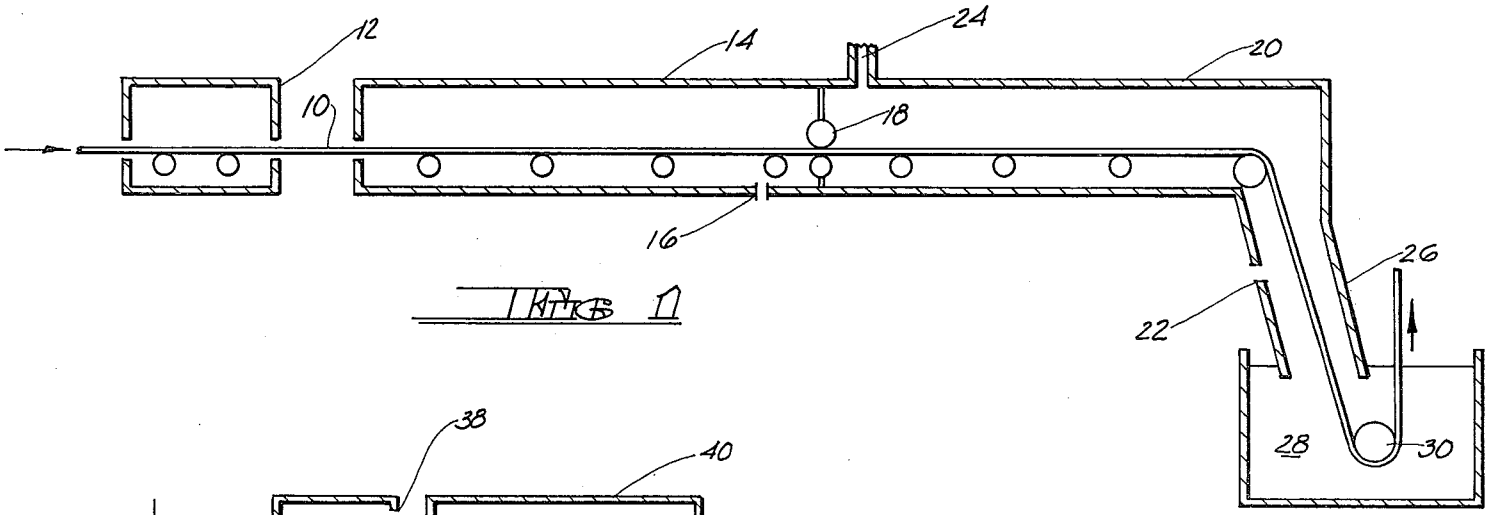
FIG. 1 is a diagrammatic illustration of a Sendzimir line modified to practice the present invention.

Referring to FIG. 1, steel strip to be treated is indicated at 10, the direction of travel being shown by arrows. An oxidizing furnace (first heating section) is shown at 12, which may be heated to a temperature of about 870° C., without atmosphere control, by combustion, electric resistance, or other conventional means. A second heating section, which may be a radiant tube furnace, is shown at 14. An inlet for nitrogen is provided as shown at 16. Baffle means 18 are provided between heating section 14 and a cooling section 20, which isolate the atmospheres in each section from one another. A hydrogen inlet into cooling section 20 is shown at 22, and a stack for flaring hydrogen is provided as shown at 24. A protective snout 26 extends downwardly beneath the surface of a coating metal bath 28, which surrounds strip 10 as it is conducted beneath the surface of the bath, around a reversing roll 30 and vertically upwardly out of the bath. Any conventional finishing means (not shown) may be used for metering and solidifying the metal coating.

Since the oxidizing furnace 12 and heating section 14 are separate, with heated strip 10 exposed to atmosphere therebetween, it is evident that the atmospheres of each are isolated from one another.

Figure 2:
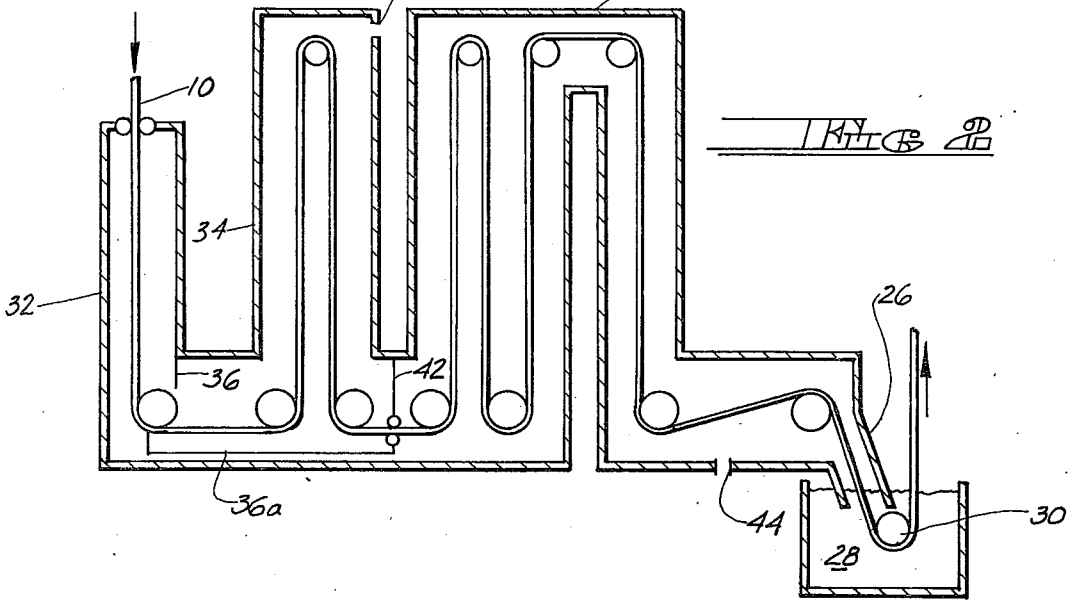
FIG. 2 is a diagrammatic illustration of a Selas line modified to practice the invention.

Referring to FIG. 2, strip 10 is shown as in FIG. 1. A direct fired preheat furnace is shown at 32, which may be heated to a temperature of at least about 1205° C. by direct combustion of fuel and air. A further heating section, which is preferably a radiant tube furnace is shown at 34, and baffle means 36, **36*a* are provided between the preheat furnace 32 and radiant tube furnace 34, thus isolating one from the other. An inlet for nitrogen into furnace 34 is shown at 38, and baffle means 42 is provided isolating the cooling section from the radiant tube furnace. An inlet for hydrogen or a hydrogen-nitrogen mixture into section 40 is shown at 44. The use of baffles 36, 36*a*, and 42 is optional with the configuration shown, as an atmosphere containing less than 5% hydrogen by volume in furnace 34 may be alternatively insured by providing a sufficiently large flow of nitrogen through inlet 38**.

The remaining elements shown in the drawing are conventional and require no discussion since the functions thereof are well known to those skilled in the art.

As is customary in continuous annealing practice, the temperature to which the stock is brought in each section occurs at or near the exit therefrom, so that there is substantially no holding time at temperature. The residence times in various sections are variable and are independent on strip thickness, heat absorptivity and related factors. In the present invention an oxide layer is maintained on the surfaces of the stock until the maximum temperature is reached, which is usually at or near the exit from the second heating zone or radiant tube furnace.

Tests have been conducted on a production Selas-type line co pampare conventional practice with that of the present invention. Conventional practice involved maintaining 3% by volume excess combustibles in the preheat furnace atmosphere (having five heating zones) and a 5% hydrogen — 95% nitrogen atmosphere in the radiant tube heating section and cooling section. When conditions were altered to the practice of the invention, i.e., approximately perfect combustion in the first four zones of the preheat furnace (0% excess combustibles and 0% oxygen), 1.5% oxygen in the fifth and final zone of the preheat furnace, less than 5% hydrogen in the radiant heating section, and 25% hydrogen–75% nitrogen by volume in the cooling section, it was found that the production rate was increased 10 to 20% in comparison to conventional practice. Complete removal of the oxide layer was effected in the cooling section in this test.

Further mill trials were conducted on low carbon rimmed steel and aluminum-killed steel strip ranging in thickness from 0.054 inch to 0.099 inch (1.4 to 2.5 mm). In the preheat furnace conventional operating conditions were initially established as follows: zone 1 had 0.7% (by volume) excess combustibles; zone 2 had 0.4% excess combustibles; zone 3 had 0.6% excess combustibles; zone 4 had 0.2% free oxygen; zone 5 had 0.3% combustibles. The strip had a light straw color exiting zone 5, indicating an extremely thin oxide film, i.e., less than $10^{-5}$ inch thickness.

Gas flow to the radiant tube furnace was then changed to pure nitrogen rather than the conventional nitrogen-hydrogen mixture, and zone 5 of the preheat furnace was adjusted to 1.3% excess oxygen in accordance with the method of the invention. The strip exiting the preheat furnace then exhibited a reddish purple to blue iridescent color, indicating an oxide layer on the order of $10^{-5}$ inches thickness. With this change in conditions the radiant tube furnace temperature began to drop (even though the firing rate was maintained at 100%), thus indicating greater heat transfer to the strip due to greater radiant energy absorptivity.

The strip exiting the radiant tube furnace was oxidized and ranged in temperature from 1350° to 1420° F. (732° to 770° C.), depending upon strip thickness and speed.

The cooling section was supplied with a 30% hydrogen-70% nitrogen mixture, and the oxide layer was reduced in the cooling section.

The line speed was increased to 110% of scheduled speed (as a conservative measure) because of the higher strip temperature in the radiant tube section.

The trials were concluded by returning to conventional practice, and it was observed that the radiant tube section temperature increased and the strip temperature decreased therein, with the firing rate maintained constant at 100%.

The above trials show that close control of the initial heating zones in the preheat furnace is not essential so long as an oxidizing atmosphere (greater than 0% and up to 2% free oxygen) is maintained in the final zone or final two zones. The initial zones may thus be operated at perfect combustion or with up to about 1% by volume excess combustibles. In the appended claims the term "substantially no excess combustibles and from 0 to 2% free oxygen by volume" is intended to cover this mode of operation (i.e., up to 1% excess combustibles in the initial heating zones but not in the final zone).

As indicated above, the method of the invention is applicable to any type of steel strip and sheet stock in thicknesses generally used for hot dip metallic coating, and to any type of generally used coating metal. Strip and sheet stock thus includes, but is not limited to, carbon steel, rimmed steel, aluminum killed steel, columbium and/or titanium treated steels, and low alloy steels of the type disclosed in U.S. Pat. No. 3,905,780, issued Sept. 16, 1975 to J. C. Jasper et al. Coating metals thus include, but are not limited to, aluminum, alloys of aluminum, zinc, alloys of zinc, and terne.

The hydrogen content of the cooling section preferably ranges from 20% to about 40% by volume, although dissociated ammonia (75% hydrogen) may also be used.

For an explanation of critical strip temperature and the variables governing the formation of an oxide layer in the Selas-type process, reference may be made to the above-mentioned Byrd et al U.S. Pat. No. 3,936,543, and particularly FIG. 3; column 3, lines 57–63; and column 4, lines 3–57.

While the invention has been described in its preferred embodiments, it will be evident that modifications may be made without departing from the spirit and scope of the invention. Thus, in some installations (both the Sendzimir and Selas types) a holding section is provided between the radiant tube section and the cooling section, in which the strip may be held at some selected temperature (usually for a short period of time) after reaching a maximum temperature in the radiant tube furnace, in order to improve the formability or modify the mechanical properties of the steel strip. An inert atmosphere such as nitrogen is maintained within such a control zone, in order to preserve the oxide film throughout this zone also. It is to be understood that the provision of such a control zone or holding step is within the scope of the present invention.

The embodiments of the invention in which an exclusive property or privilege is claimed are defined as follows:

1. A method of preparing the surfaces of steel strip and sheet stock for fluxless hot dip coating with molten metal, comprising the steps of passing the stock through a first heating section containing an atmosphere of gaseous products of combustion having substantially no excess combustibles and from 0% to 2% free oxygen by volume in which atmosphere said stock is heated to a temperature above that at which said stock is oxidized and within the range of about 540° to about 705° C. whereby to form a visible iron oxide layer on the stock surfaces in the color range of dark straw through blue, continuing the heating of said stock without exposure thereof to outside atmosphere in a second heating section isolated from said first heating section in an atmosphere containing less than 5% hydrogen by volume and the balance a gas inert to said oxide layer, thereby preserving said oxide layer, and cooling said stock approximately to the temperature of the molten coating metal in a cooling section isolated from said heating sections, said cooling section containing a reducing atmosphere comprising at least 10% hydrogen by volume, whereby to reduce said iron oxide layer completely to a metallic iron surface wettable by said coating metal.

2. The method claimed in claim 1, wherein said stock is heated in said second heating section to 675° to about 925° C.

3. The method claimed in claim 1, wherein said second heating section is a radiant tube furnace.

4. A method of preparing the surfaces of steel strip and sheet stock for fluxless hot dip coating with molten metal, comprising the steps of passing the stock through a first heating section containing an uncontrolled atmosphere in which said stock is heated from about 370° to about 485° C., passing said stock into outside atmosphere whereby to form a visible iron oxide layer on the stock surfaces in the color range of dark straw through blue, continuing the heating of said stock in a second heating section isolated from said first heating section in an atmosphere containing less than 5% hydrogen by volume and the balance a gas inert to said oxide layer, thereby preserving said oxide layer, and cooling said stock approximately to the temperature of the molten coating metal in a cooling section isolated from said heating sections, said cooling section containing a reducing atmosphere comprising at least 10% hydrogen by volume, whereby to reduce said iron oxide layer completely to a metallic iron surface wettable by said coating metal.

5. The method claimed in claim 4, wherein said stock is heated to about 735° to about 925° C. in said second heating section.

6. In a method of preparing the surfaces of steel strip and sheet stock for fluxless hot dip coating with molten metal, including the steps of passing the stock through a first heating section under conditions which form a visible iron oxide layer on the stock surfaces, continuing the heating of said stock in a further heating section in a reducing atmosphere to reduce said oxide layer to a metallic iron surface, and cooling said stock approximately to the temperature of the molten coating metal in an atmosphere reducing to iron oxide to maintain said iron surface, the improvement which comprises preserving said oxide layer throughout said further heating section in an atmosphere containing less than 5% hydrogen by volume and the balance inert gas, whereby to increase the radiant energy absorptivity of said stock, and reducing said iron oxide layer to a metallic iron surface wettable by said coating metal in a reducing atmosphere comprising at least 10% hydrogen by volume while cooling said stock.

7. The improvement claimed in claim 6, including the step of holding said material at a selected lower temperature in a control zone having an atmosphere therein inert to iron oxide after passing through said further heating section and prior to cooling of said material.

* * * * *